US010905221B2

(12) United States Patent
Hood

(10) Patent No.: US 10,905,221 B2
(45) Date of Patent: Feb. 2, 2021

(54) PORTABLE LIPSTICK KIT

(71) Applicant: Sandra D. Hood, Jonesboro, GA (US)

(72) Inventor: Sandra D. Hood, Jonesboro, GA (US)

( * ) Notice: Subject to any disclaimer, the term of this patent is extended or adjusted under 35 U.S.C. 154(b) by 978 days.

(21) Appl. No.: 14/856,957

(22) Filed: Sep. 17, 2015

(65) Prior Publication Data

US 2016/0081457 A1 Mar. 24, 2016

Related U.S. Application Data

(60) Provisional application No. 62/052,647, filed on Sep. 19, 2014.

(51) Int. Cl.

| | |
|---|---|
| ***A45D 42/02*** | (2006.01) |
| ***A45D 42/10*** | (2006.01) |
| ***A45D 40/18*** | (2006.01) |
| ***A45D 40/22*** | (2006.01) |
| ***A45D 40/26*** | (2006.01) |
| *A45D 40/02* | (2006.01) |
| *A45D 34/04* | (2006.01) |

(52) U.S. Cl.

CPC ..... *A45D 42/02* (2013.01); *A45D 40/18* (2013.01); *A45D 40/22* (2013.01); *A45D 40/265* (2013.01); *A45D 42/10* (2013.01); *A45D 34/045* (2013.01); *A45D 40/02* (2013.01)

(58) Field of Classification Search

CPC ..... A45D 42/22; A45D 42/10; A45D 42/02; A45D 40/265; A45D 40/262; A45D 40/18; A45D 40/14; A45D 40/22; A45D 2040/0012; A45D 2040/0018; A45D 2040/005; A45D 34/045

USPC ..... 401/112, 129, 155

See application file for complete search history.

(56) References Cited

U.S. PATENT DOCUMENTS

| | | | | |
|---|---|---|---|---|
| 2,103,577 | A * | 12/1937 | O'Moore | A45D 42/02 132/316 |
| 2,294,257 | A * | 8/1942 | Udvarhely | A45D 40/18 132/318 |
| 5,137,038 | A * | 8/1992 | Kingsford | A45D 40/265 132/218 |
| 9,101,193 | B1 * | 8/2015 | Liu | A45D 33/32 |
| 2005/0135088 | A1 * | 6/2005 | Helenowski | A45D 33/008 362/136 |
| 2007/0110502 | A1 * | 5/2007 | Salciarini | A45D 40/00 401/131 |

(Continued)

*Primary Examiner* — Rachel R Steitz
*Assistant Examiner* — Brianne E Kalach

(57) ABSTRACT

A lipstick kit is provided to allow for use of the last bit of lipstick in a lipstick container, which is normally discarded due to great difficulty in applying this last bit. The lipstick kit also allows the application of lipstick in environments that lack mirrors or sufficient ambient lighting. The lipstick kit is formed from an elongated container with attached lid and corresponding elongated applicator. A mirror is housed in a slot of a lateral wall of the elongated container, while a height-adjustable floor is added above a base of the elongated container. The height-adjustable floor can be raised or lowered by a tab, making stored lipstick easier to access. An interior divider separates the elongated container into a primary compartment for the lipstick container and a secondary compartment for extra applicators. Applicators can be removed from the lid and discarded or cleaned after each use.

4 Claims, 19 Drawing Sheets

(56) References Cited

U.S. PATENT DOCUMENTS

2011/0103873 A1* 5/2011 Chou ..... A45D 40/02
401/52

* cited by examiner

PORTABLE LIPSTICK KIT

The current application claims a priority to the U.S. Provisional Patent application Ser. No. 62/052,647 filed on Sep. 19, 2014.

FIELD OF THE INVENTION

The present invention relates generally to a cosmetics accessory, more particularly, to an accessory that can store and apply makeup. The cosmetics accessory will allow a user to extract the maximum amount of lipstick from a partially used lipstick tube.

BACKGROUND OF THE INVENTION

The present invention is designed to be a stylish fashion accessory that allows a user to stay focused on practicality and frugality. The present invention can be used in crowded restrooms, on the go, or in the most fashion critical environments. The design of many popular lipstick tubes forces a user to discard the tube with a substantial amount of lipstick still trapped within the lipstick tube. This is wasteful, and forces a user to get rid of a tube of lipstick whose usefulness can be extended. To address this problem in a fashion conscious manner, the present invention allows a user to store a partially used tube of lipstick in an attractive enclosure. The attractive enclosure includes an applicator for extracting the residual lipstick from the stored tube. In addition to enabling a user to maximize the use of a tube of lipstick, the present invention includes a mirror that a can be used to apply makeup when needed. Rather than using a Q-tip or another unattractive means of extracting lipstick the present invention enables a user to remain at the height of fashion while being incredibly frugal. The present invention also includes a source of light, allowing the present invention to be utilized in situations with poor lighting, such as movie theaters and during night time. A height-adjustable floor can be raised to make the stored lipstick easier to access with the applicator by moving the lipstick closer to an opening of the enclosure.

The present invention receives partially used lipstick tube, which a user may then extract by gathering the lipstick with an applicator. A lid of the present invention may be secured to protect the lipstick tube when not in use. The present invention is suitable for emergency use in a number of fashion critical situations, further facilitated by the inclusion of a mirror, light, and storage space for multiple applicators. Rather than being forced to purchase an entirely new tube of lipstick, when the remaining amount is insufficient for direct application, a user of the present invention will be able to save money by extracting all residual lipstick from a partially used tube before it needs to be discarded. Situations in which the present invention proves useful include, but are not limited to, applying lipstick in a car before entering a restaurant, in theaters, and ultimately in any area where ideal conditions for lipstick application are not present.

DETAIL DESCRIPTIONS OF THE INVENTION

All illustrations of the drawings are for the purpose of describing selected versions of the present invention and are not intended to limit the scope of the present invention.

The present invention is a portable apparatus that allows a user to apply lipstick (as well as other cosmetics) in scenarios where access to illumination and a reflective surface is not available, convenient, or otherwise accessible. An additional benefit of the present invention is the ability to use 100% of the contents of a lipstick container; since the last bit of lipstick is usually difficult to apply many persons waste money by discarding lipstick containers that retain a percentage of the full amount. The present invention is illustrated in FIG. 1-FIG. 11, with an alternate construction shown in FIG. 12-FIG. 17.

Figure 18:
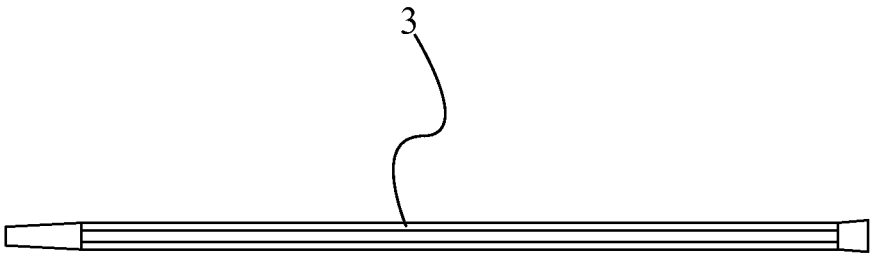
FIG. 18 is a side perspective view of the applicator of the present invention.
Figure 19:
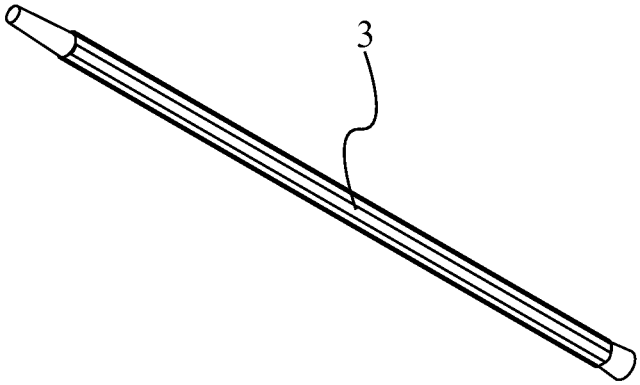
FIG. 19 is an isometric view of the applicator of the present invention.

To this end, the present invention comprises an elongated container 1, a lid 2, an elongated applicator 3, and a mirror 4. The lid 2 covers the container when not in use, and as such the lid 2 is attached adjacent to an opening 11 of the elongated container 1. The elongated applicator 3, which allows for transfer of lipstick from a lipstick tube to a user's lips, is adjacently attached to the lid 2. The elongated applicator 3 can thus be manipulated by a user by means of the lid 2, which effectively serves as a handle for said elongated applicator 3. The elongated container 1 itself comprises a base 12 and a lateral wall 13. The lid 2 and base 12 are positioned at opposite ends of each other along the lateral wall 13. The lateral wall 13 is perimetrically and adjacently connected to the base 12, forming an enclosed region between the lateral wall 13, base 12, and lid 2. This enclosed region is suitable for receiving a lipstick container, as later described. The lateral wall 13 comprises a slot 131, which serves to house the mirror 4 when not in use. The slot 131 traverses into the lateral wall 13, preferably tangent to the wall, such that the mirror 4 is coplanar with a planar face of the wall; this leaves the interior volume of the elongated container 1 open, rather than requiring some interior volume to be allocated for the slot 131 and mirror 4. The mirror 4 can slide into and out of the slot 131, resulting from a slidable engagement between the mirror 4 and the slot 131. The mirror 4 is shown retracted from the slot 131 in FIG. 11, while the applicator is shown individually in FIG. 18 and FIG. 19.

The core of the present invention, as thus described, provides a portable housing for a lipstick tube. The removable lid 2 and attached elongated applicator 3 allow for lipstick to be transferred from said lipstick tube to a person's lips. The application of the lipstick is aided by the mirror 4, which can be pulled out of the slot 131 when the present invention is actively being utilized. A number of properties for the introduced components are not restricted; for example, the shape of the elongated container 1 is illustrated as being hexagonal, but in other embodiments the profile of the base 12 could be circular, triangular, or other geometric constructions. The only restriction regarding the shape is the ability to integrate a slot 131 for housing the mirror 4. Most often this will be at least one planar face that is capable of receiving the mirror 4 (as mirrors 4 are most commonly flat objects), though specially constructed mirrors 4 could be constructed for use with irregularly shaped elongated containers 1. Potentially, to assist with releasing the mirror 4 from the slot 131, the mirror 4 can be spring-loaded. In other embodiments, rather than sliding in and out of the slot 131, the mirror 4 can be hingedly connected to the lateral wall 13 adjacent to the base 12. The mirror 4 can then be rotated in and out of the slot 131, as opposed to sliding.

Another variable aspect of the present invention is the means by which the lid 2 is attached to the elongated container 1. For example, in one embodiment the lid 2 can be secured to the elongated container 1 by means of matching threading on the lid 2 and elongated container 1. This matching threading allowing the lid 2 to be screwed on and off of the elongated container 1. In another embodiment, the lid 2 is secured to the elongated container 1 through a simple press fit (also referred to as an "interference fit") that allows a user to simply snap the lid 2 in and out of contact with the elongated container 1. These are just a few example of potential means of attachment between the lid 2 and the elongated container 1; others means remain possible within the scope of the present invention.

Similar to how the lid 2 may be secured to the elongated container 1 by various means, the elongated applicator 3 can be secured to the lid 2 in a variety of ways. In one embodiment, the elongated applicator 3 is screwed into the lid 2, held in place by a threaded engagement. In another embodiment, the elongated applicator 3 comprises a lip that can be inserted into a corresponding receptacle of the lid 2, thus securing the elongated applicator 3 to the lid 2. Ultimately, the elongated applicator 3 comprises a body with an interactive end (used for collecting and applying cosmetics) and a connector, the connector being positioned at the end opposite the interactive end. The connector is engaged with a matching connector on the lid 2 to attach the elongated applicator 3 to the lid 2.

The present invention as heretofore described provides a portable apparatus which is capable of storing a lipstick tube as well as applying the lipstick to one's lip. As mentioned, the application benefits from the inclusion of a mirror 4. The mirror 4 allows a user to visually check their application of lipstick and make adjustments as necessary. However, users may sometimes find themselves in situations where ambient illumination is insufficient and a source of better illumination is unavailable. As the mirror 4 requires a certain amount of light to be used, the present invention preferably comprises at least one illumination source 5. The at least one illumination source 5 enables the present invention to be utilized in darkness and low light conditions; the mirror 4 will remain usable in poor lighting conditions through provision of the at least one illumination source 5. Specific placement and activation of the at least one illumination source 5 can be varied between embodiments of the present invention; a few examples are subsequently detailed.

Figure 1:
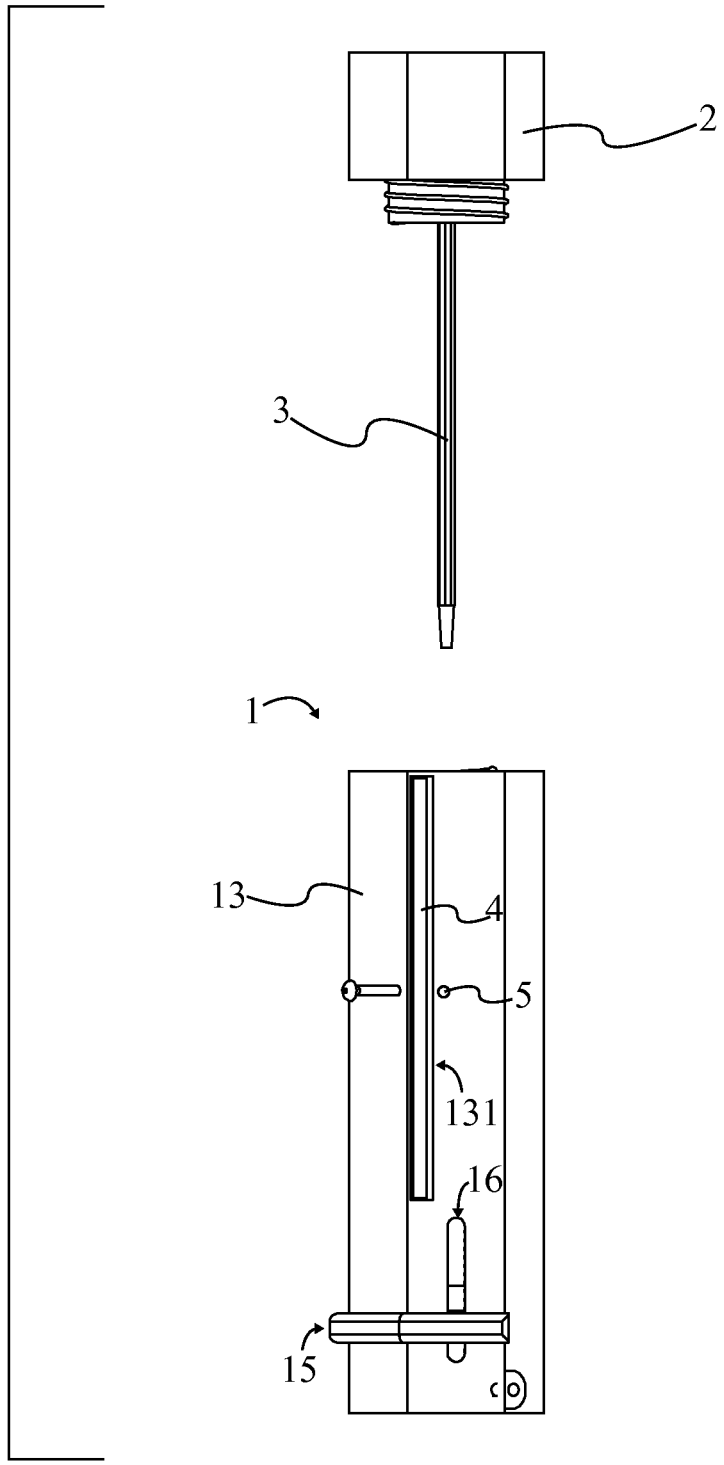
FIG. 1 is a front perspective view of the present invention with a lid and applicator detached from the housing.
Figure 2:
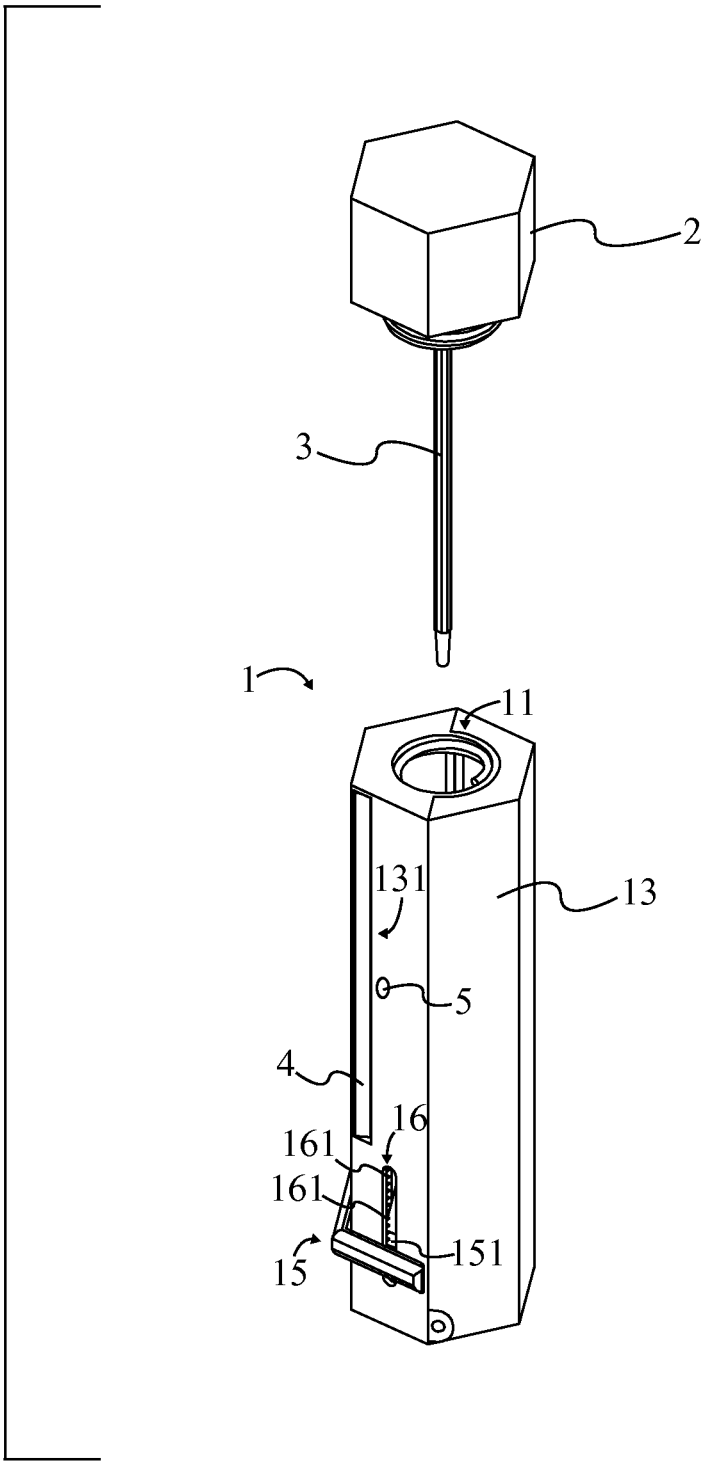
FIG. 2 is a top isometric view of the present invention with the lid and applicator detached from the housing.
Figure 3:
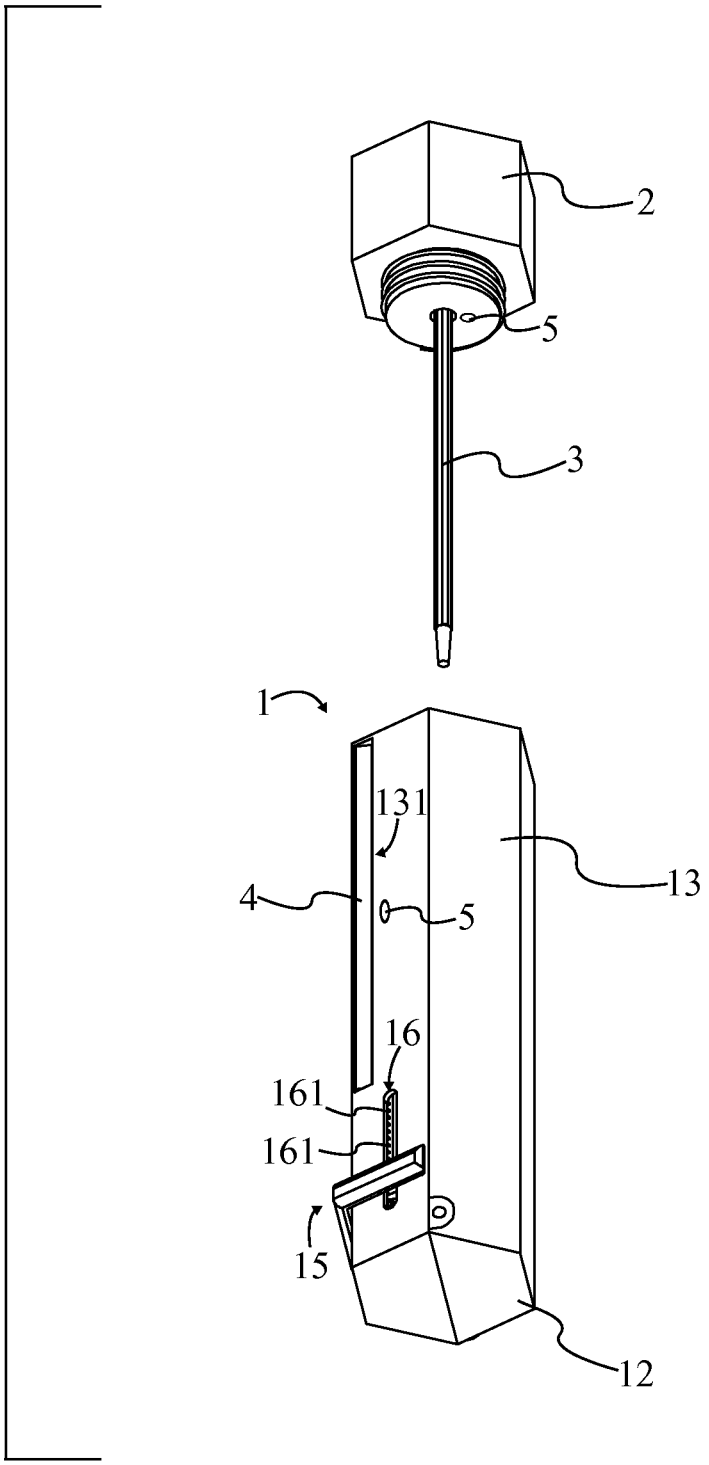
FIG. 3 is a bottom isometric view of the present invention with the lid and applicator detached from the housing.
Figure 4:
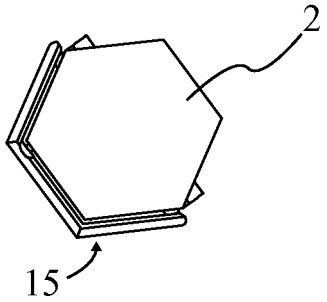
FIG. 4 is a top perspective view of the present invention.
Figure 5:
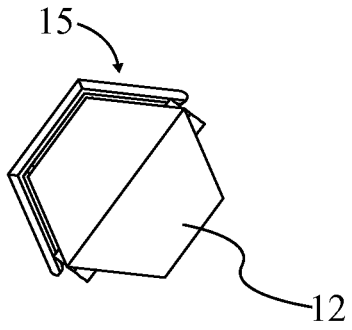
FIG. 5 is a bottom perspective view of the present invention.
Figure 6:
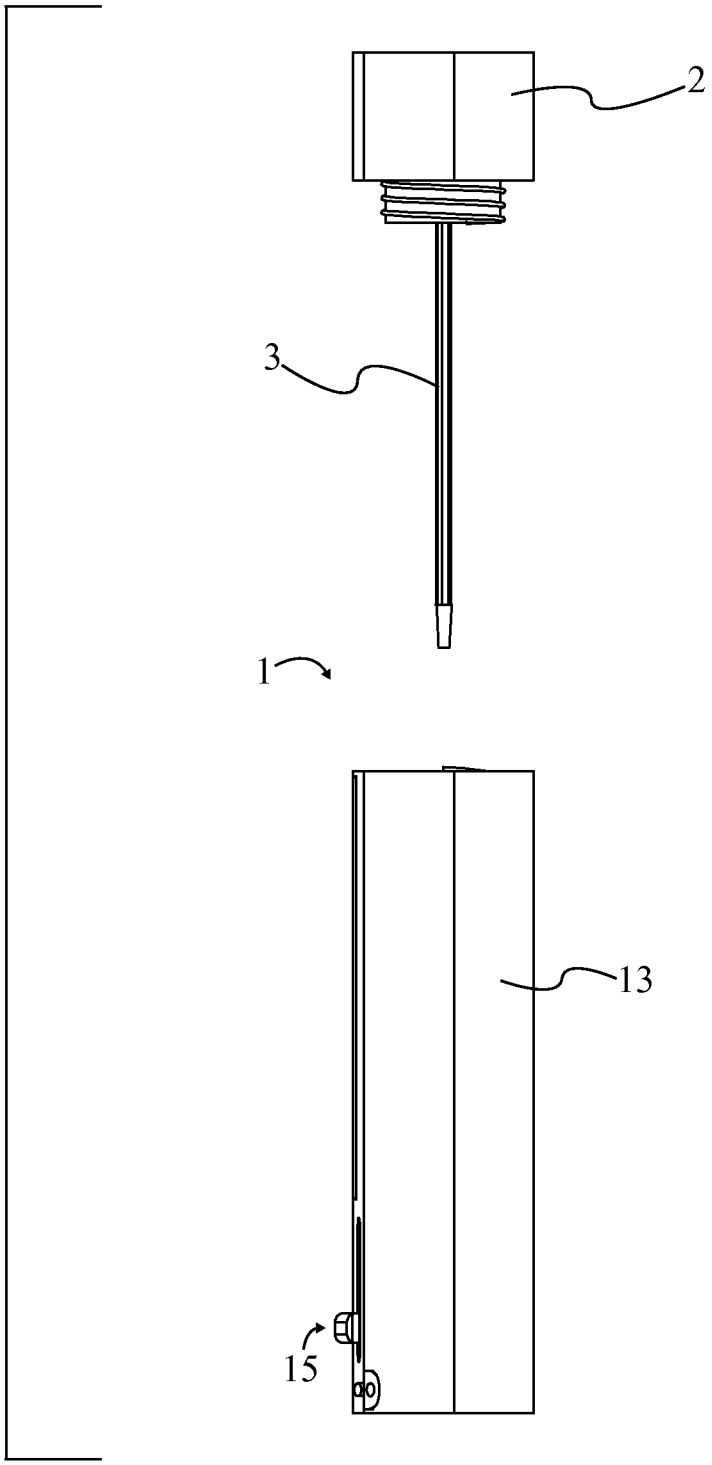
FIG. 6 is a left perspective view of the present invention with the lid and applicator detached from the housing.
Figure 7:
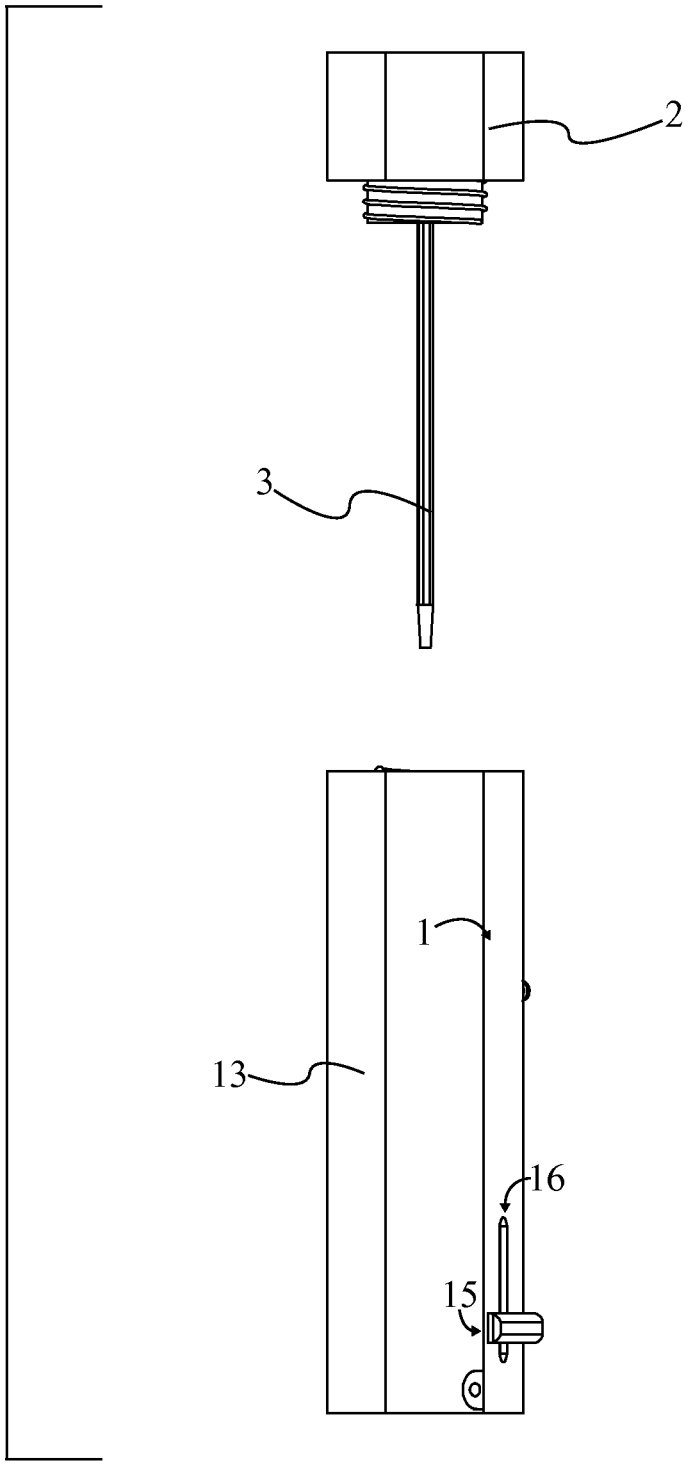
FIG. 7 is a right perspective view of the present invention with the lid and applicator detached from the housing.
Figure 8:
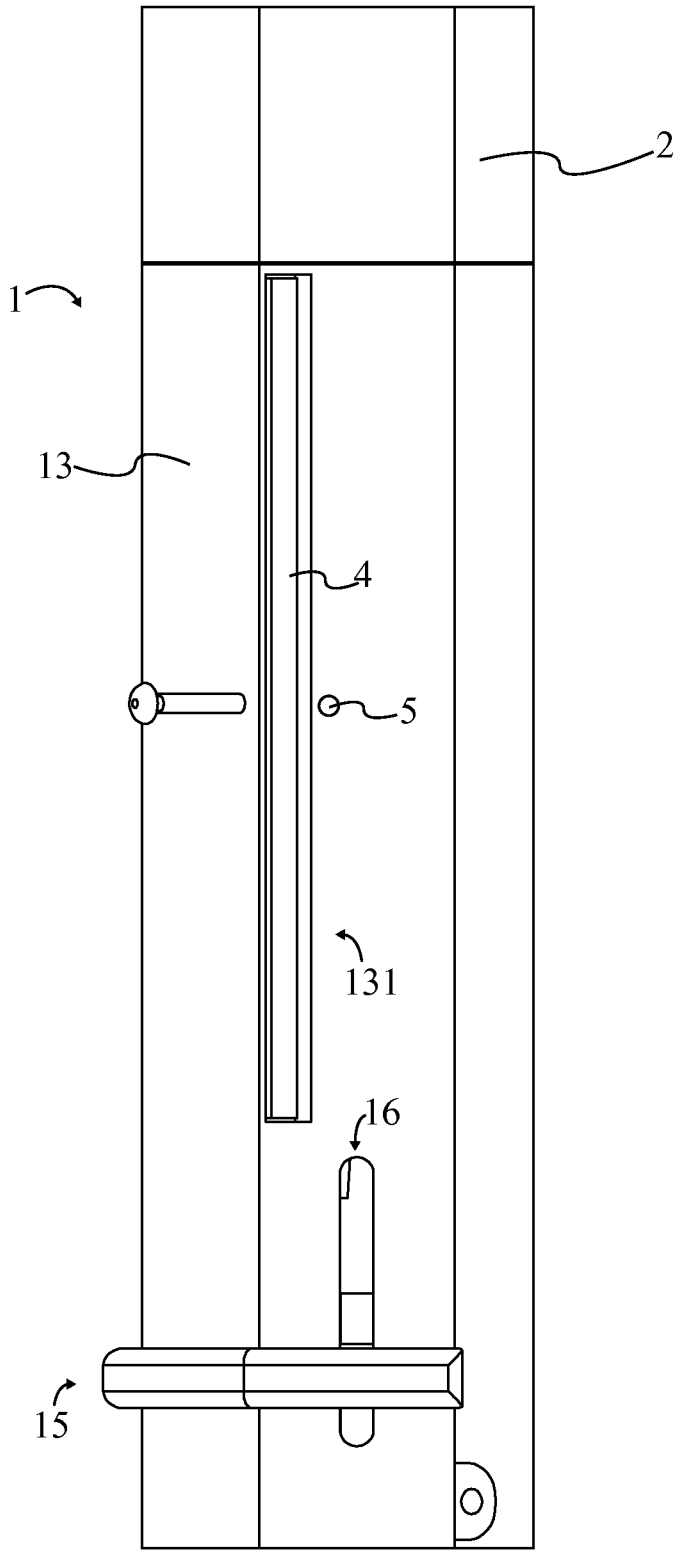
FIG. 8 is a front perspective view of the present invention with the lid and applicator attached to the housing.
Figure 9:
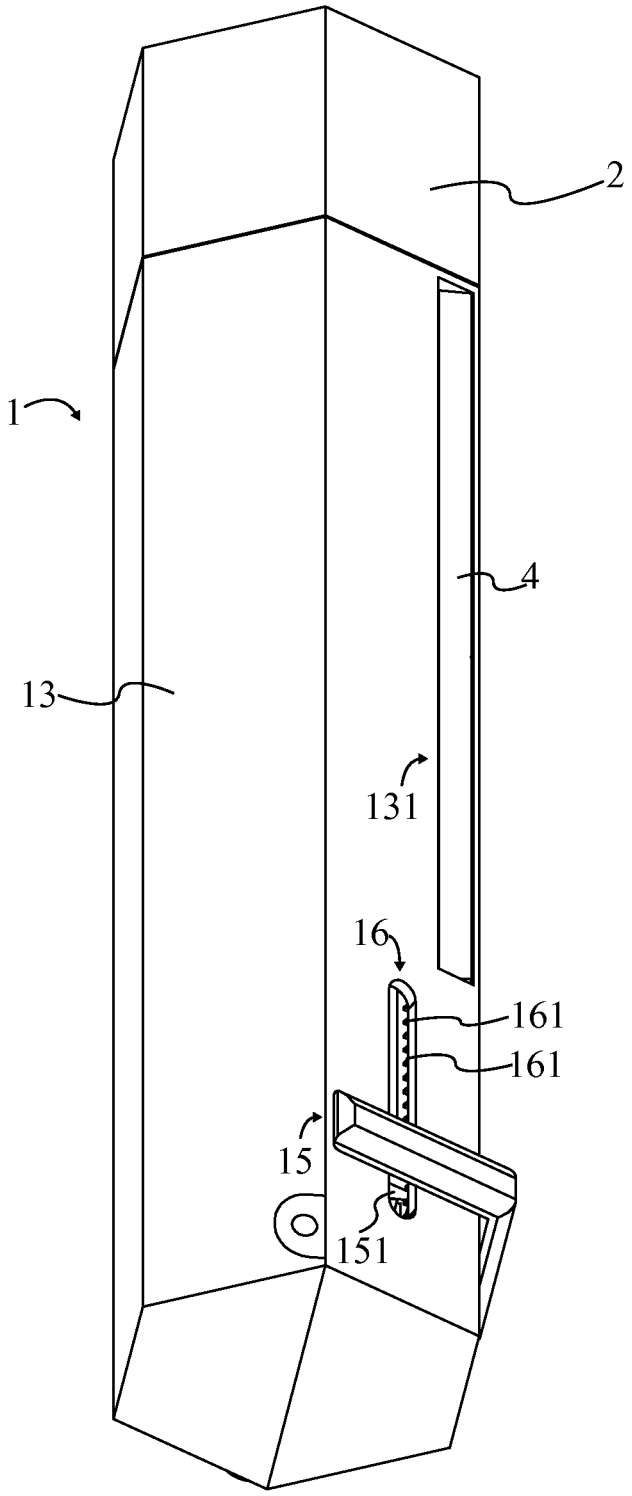
FIG. 9 is a bottom isometric view of the present invention with the lid and applicator attached to the housing.
Figure 10:
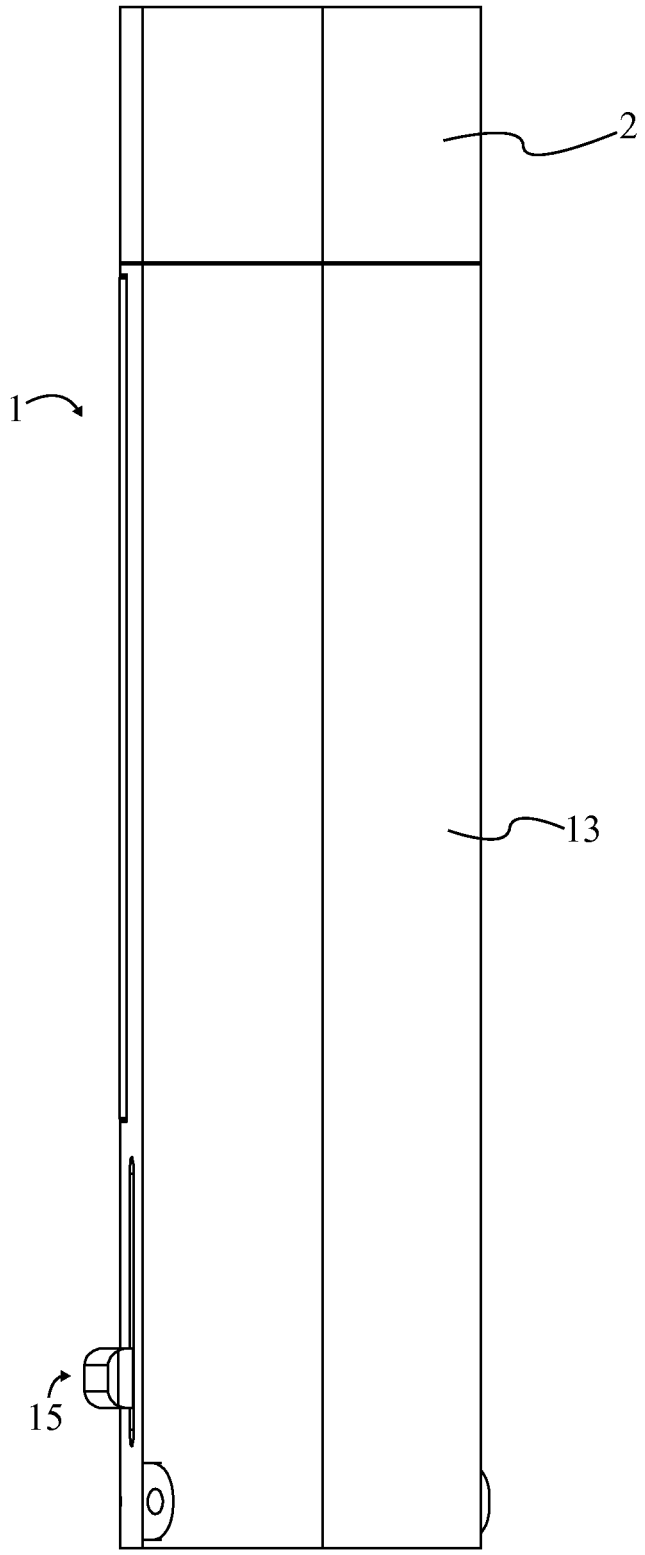
FIG. 10 is a left perspective view of the present invention with the lid and applicator attached to the housing.

In one embodiment, the illumination source 5 is mounted to the mirror 4 itself. The illumination source 5 is preferably connected adjacently to the perimeter of the mirror 4, leaving the reflective surface of the mirror 4 unimpeded. Effectively, in this embodiment the illumination source 5 is integrated as part of the mirror 4. This placement is illustrated in FIG. 1-FIG. 3.

Figure 11:
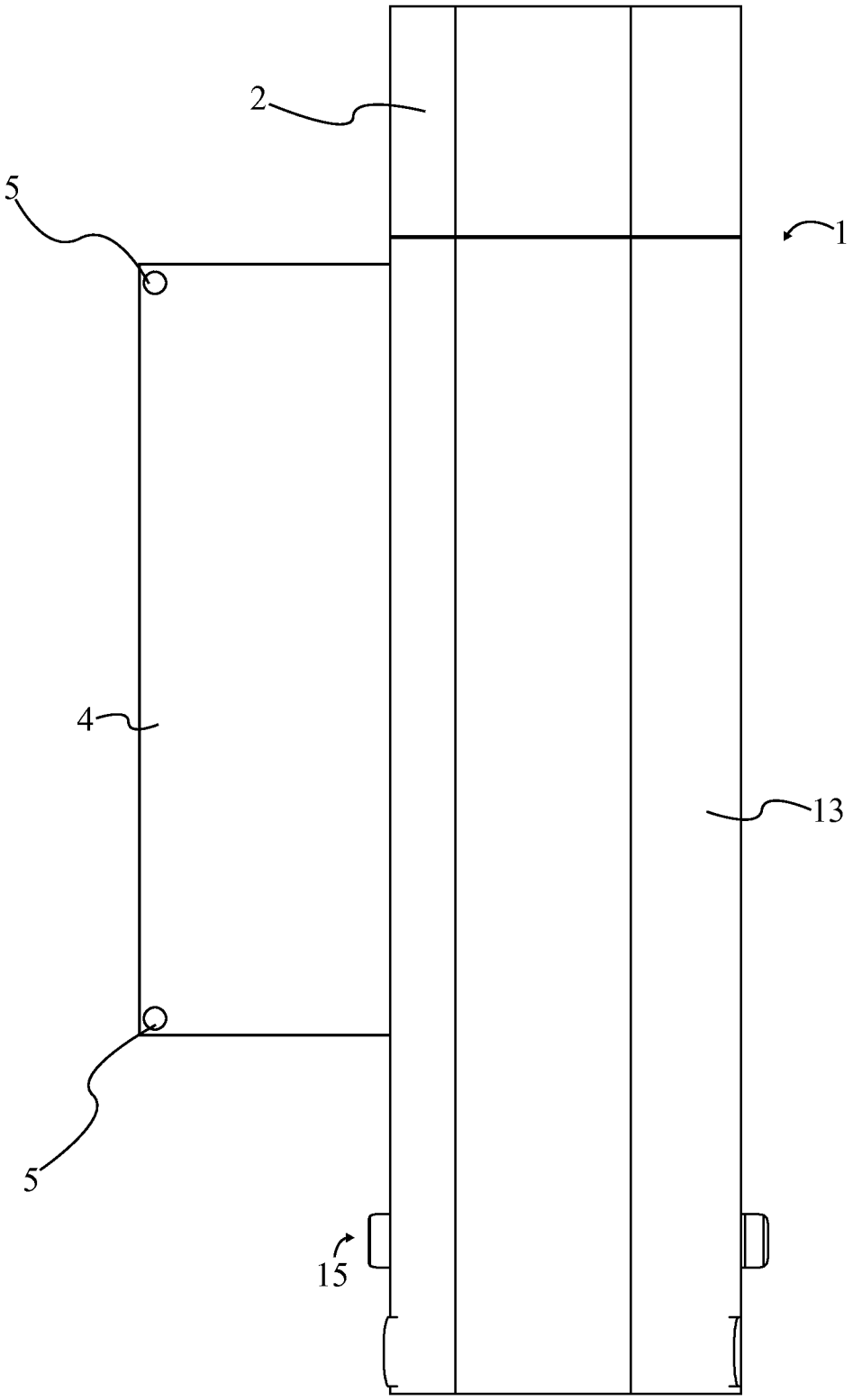
FIG. 11 is a perspective view of the present invention with a mirror extended from a slot.
Figure 12:
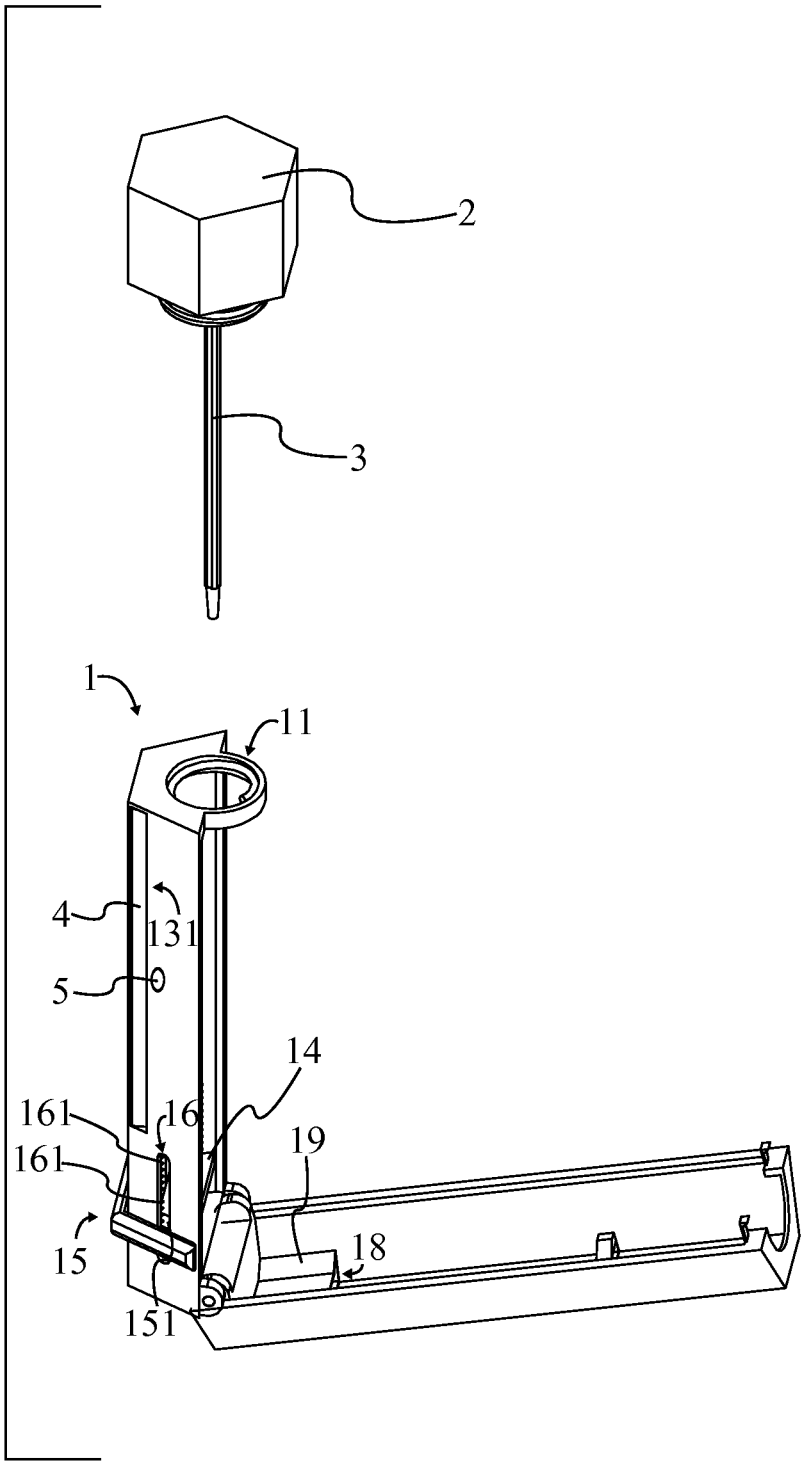
FIG. 12 is a perspective view of the present invention with the housing in an open position.
Figure 13:
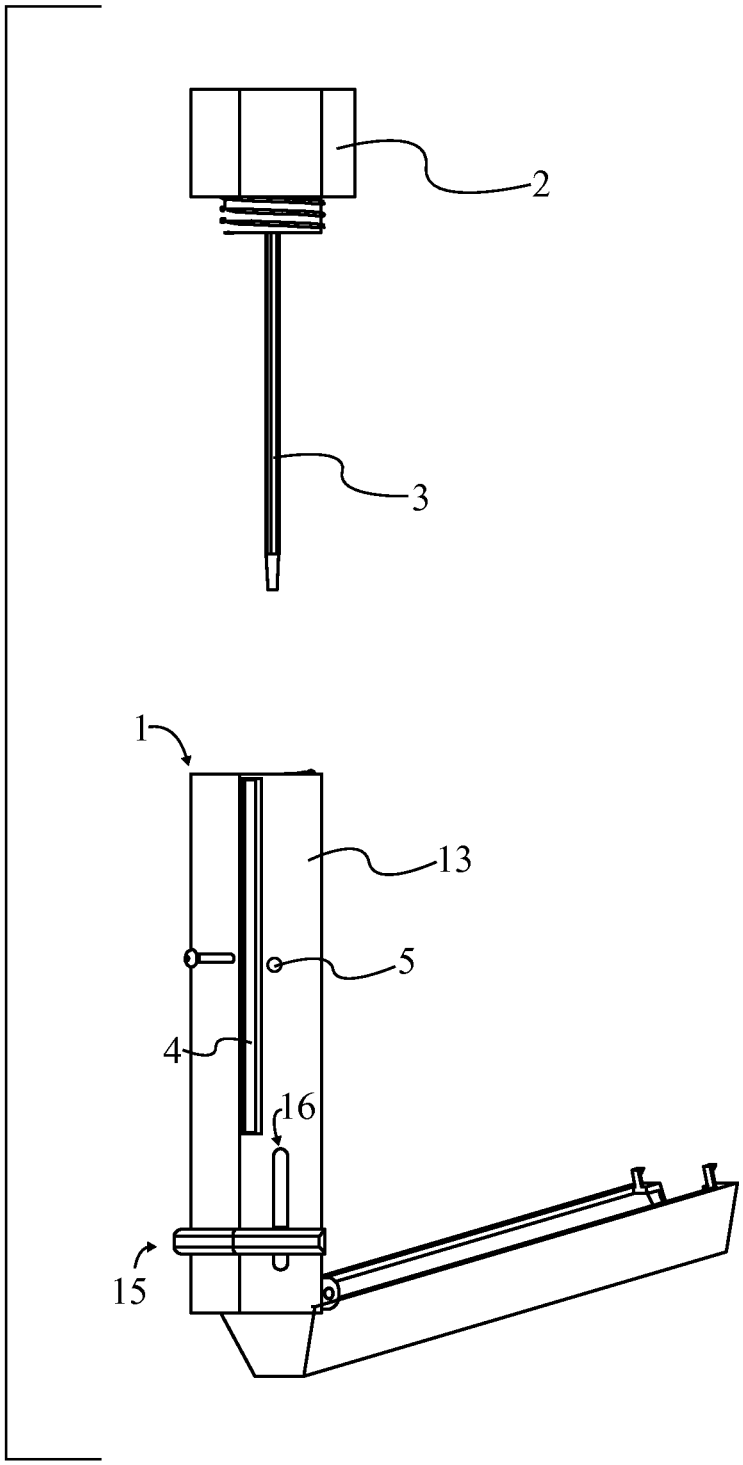
FIG. 13 is an isometric view of the present invention with the housing in an open position.
Figure 14:
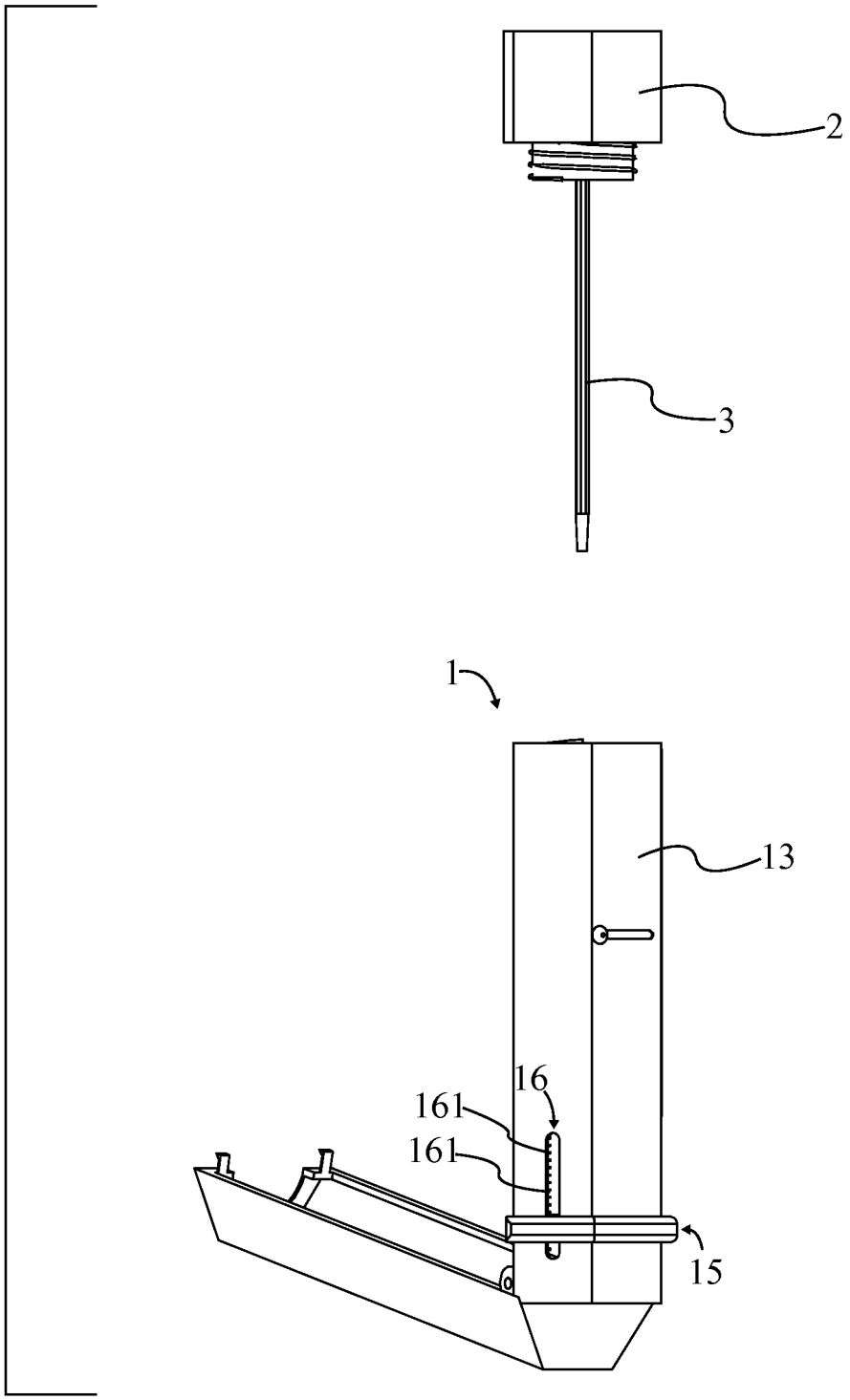
FIG. 14 is a back isometric view of the present invention with the housing in an open position.
Figure 15:
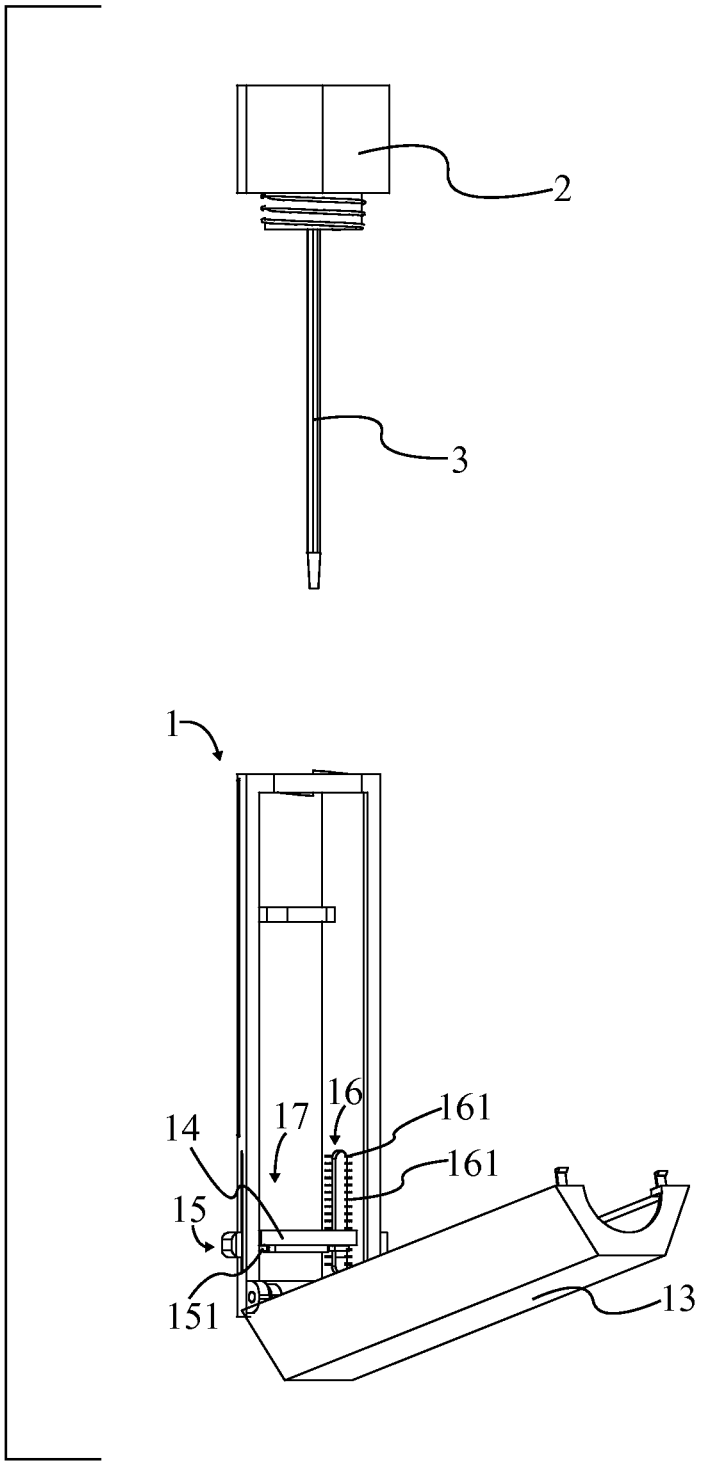
FIG. 15 is a front isometric view of the present invention with the housing in an open position.
Figure 16:
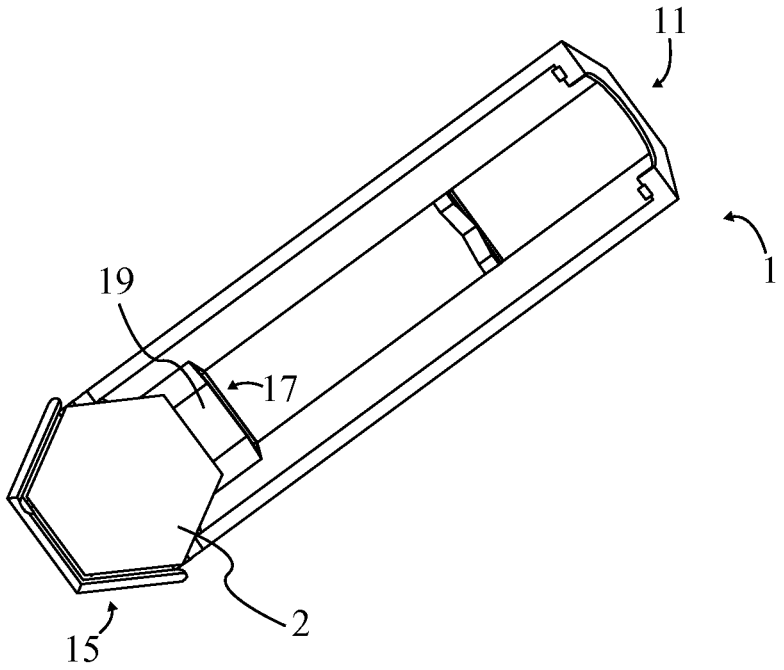
FIG. 16 is a top perspective view of the present invention with the housing in an open position.
Figure 17:
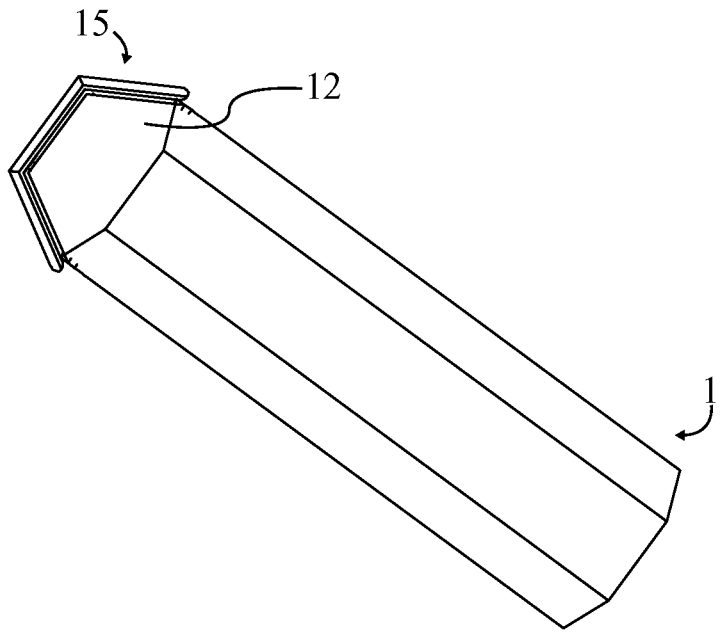
FIG. 17 is a bottom perspective view of the present invention with the housing in an open position.

In another similar embodiment, the illumination source 5 is instead mounted to the lateral wall 13. Further defining the adjacent connection of the illumination source 5 to the lateral wall 13, the illumination source 5 is positioned adjacent to the slot 131. This placement ensures that the generated light is focused on the mirror 4. This embodiment is very similar to the previously described embodiment, with the main difference being that this embodiment integrates the illumination source 5 into the lateral wall 13 rather than the mirror 4. This placement is illustrated in FIG. 11.

In a third embodiment, the illumination source 5 is integrated as part of the lid 2, with the illumination source 5 being adjacently connected to the lid 2. Preferably, the illumination source 5 is positioned on the same face of the lid 2 as the elongated applicator 3. Resultantly, the illumination source 5 lights up the area around the elongated applicator 3. As the illumination source 5 is mounted to the lid 2 in this embodiment, it can be wielded as a flashlight when the lid 2 is detached from the elongated container 1. This provided a user with added flexibility, as the illumination can be used to both illuminate their face as well as the mirror 4. This placement is illustrated in FIG. 3.

Other placements of the illumination source 5 are possible beyond those that have been described. Ultimately, any placement of illumination source 5 is suitable as long as the illumination source 5 is capable of providing enough light for use of the mirror 4 in darkness or low light conditions.

The manner in which the illumination sources 5 are activated and deactivated can also vary between embodiments of the present invention. The means of activating and deactivating the illumination sources 5 can be manual or automated. Manual activation and deactivation is achieved by providing an on/off switch or similar interface for user interaction. The user simply moves the switch to an on-position to activate the illumination source 5 and to an off-position to deactivate the illumination source 5. The switch itself is preferably positioned adjacent to the illumination source 5, but ultimately can be placed anywhere on the present invention. For simplicity, the switch is ideally positioned on the same body as the illumination source 5; for example, if the illumination source 5 is mounted to the elongated container 1, then the switch is also mounted to the elongated container 1. Likewise, if the illumination source 5 is mounted to the lid 2, so is the switch. The switch itself could instead be replaced with a button or ultimately any interface that allows a user to activate and deactivate the illumination source 5.

In embodiments that utilize automated activation and deactivation of the illumination source 5, a switch or similar interface is not needed. Instead, movement of the mirror 4 triggers the illumination source 5. For example, when the mirror 4 is moved out of the slot 131 (i.e. to an in use position), an electrical contact on the mirror 4 can complete the electrical circuit for the illumination source 5, automatically activating the illumination source 5. The circuit is broken and the illumination source 5 is deactivated when the mirror 4 is returned to its storage configuration within the slot 131. This is just one example of a means for automatically activating and deactivating the illumination source 5; other embodiments can implement alternative methods of doing so.

The present invention is compatible with any number of additional illumination sources 5; additional illumination sources 5, though not required, can help to improve the quality of lighting. For embodiments that utilize multiple illumination sources 5, the illumination sources 5 can be clustered together (for example, around the perimeter of the mirror 4) or distributed across the present invention (for example, some on the lateral wall 13 and others on the lid 2).

To make a stored lipstick container more accessible to a user, the present invention preferably comprises a height-adjustable floor 14. The height-adjustable floor 14 moves up and down within the elongated container 1, being slidably engaged with the lateral wall 13. This is desirable, as a user can move the height-adjustable floor 14 closer to the opening 11 of the elongated container 1, making the supported lipstick tube easier to access. In other words, as the amount of lipstick remaining on the lipstick tube is depleted, a user can simply move the height-adjustable floor 14 (and correspondingly the lipstick tube) upwards to facilitate access towards the remaining amount of lipstick.

The manner in which the height-adjustable floor 14 is moved along the lateral wall 13 is not restricted; in the illustrated embodiment movement is accomplished through a tab 15. The tab 15 is adjacently connected to the height-adjustable floor 14 through a channel 16, the channel 16 being integrated into the lateral wall 13. A user can thus use the tab 15 to manipulate the position of the height-adjustable floor 14; sliding the tab 15 towards the opening 11 raises the height-adjustable floor 14, while sliding the tab 15 towards the base 12 lowers the height-adjustable floor 14.

Potentially, is it is possible for the height-adjustable floor 14 to be held in a selected position by frictional forces between the height-adjustable floor 14 and the lateral wall 13. However, as frictional forces also increase resistance when moving the height-adjustable floor 14 along the lateral wall 13, it is preferably for there to be an independent locking mechanism.

The locking mechanism can be implemented in a number of ways; in the illustrated embodiment, the tab 15 comprises a latching mechanism 151. The latching mechanism 151 interacts with a plurality of latch receptacles 161, the plurality of latch receptacles 161 being adjacently connected along the lateral wall 13. The combination of the latching mechanism 151 and the latch receptacles 161 serves as the locking mechanism in this embodiment. The latching mechanism 151 is selectively engaged with one of the plurality of latch receptacles 161. A user disengages the latching mechanism 151 from one of the plurality of latch receptacles 161 to allow for repositioning of the height-adjustable floor 14. Once a user has moved the height-adjustable floor 14 the desired position, the latching mechanism 151 is engaged with another of the plurality of latch receptacles 161 in order to lock the height-adjustable floor 14 in place.

Expanding upon the latching mechanism 151 and plurality of latch receptacles 161 in the illustrated embodiment, the latching mechanism 151 is an adjustment piston and the plurality of latch receptacles 161 is a pair of strips of adjustment grooves, one on either side of the channel 16. The adjustment piston comprises piston springs and groove mounts; the piston springs push the groove mounts against the adjustment grooves, which locks the adjustment piston with a pair of the adjustment grooves. A grip is provided for the adjustment groove; the user is able to squeeze the grip in order to compress the piston springs. Compression of the piston springs disengages them from the groove mounts, allowing the height-adjustable floor 14 to be moved. Once the height-adjustable floor 14 is at the desired position, the user simply releases the grip, which relieves the pressure on the pistons. The pistons thus return to an equilibrium position and engage with the adjustment grooves, locking the height-adjustable floor 14 in the new position.

In other embodiments, the height-adjustable floor 14 can be threadably engaged with a threaded rod that centrally traverses through the elongated container 1. The threaded rod is connected to a rotatable knob positioned just below the base 12; a user could thus rotate the knob to turn the threaded rod. The rotation of the threaded rod causes the coupled height-adjustable floor 14 to move up and down along the threaded rod. Effectively, a user can raise and lower the height-adjustable platform via rotation of the knob and rod. An advantage of this mechanism is that a separate locking mechanism does not need to be provided; the height-adjustable floor 14 only moves when the knob is rotated. Further embodiments that utilize different locking mechanisms are possible still, and ultimately a locking mechanism can be omitted entirely if so desired by a manufacturer.

As the elongated applicators 3 are intended to be disposable (ensuring the different colors of lipstick do not mix), it is desirable to provide space within the elongated container 1 for additional elongated applicators 3. Thus, in one embodiment, the interior volume of the elongated container 1 is divided into a primary compartment 17 and a secondary compartment 18. The elongated container 1 comprises an interior divider 19, an interior wall that delineates the primary compartment 17 and the secondary compartment 18. The primary compartment 17 is positioned on one side of the interior divider 19, defined between the interior divider 19 and the lateral wall 13. The secondary compartment 18 is positioned on the opposite side of the interior divider 19 (i.e. opposite the primary compartment 17) and is also defined between the interior divider 19 and the lateral wall 13. The interior divider 19 is connected across the lateral wall 13, with each end of the interior divider 19 being connected to an interior surface of the lateral wall 13. In embodiments where the height-adjustable floor 14 is provided, a bottom of the interior divider 19 is adjacently connected to the height-adjustable floor 14. In embodiments without the height-adjustable floor 14, the bottom of the divider is adjacently connected to the base 12. The interior divider 19 and resulting primary compartment 17 and secondary compartment 18 are visible in FIG. 12, FIG. 15, and FIG. 16.

While any sort of contents could be placed in the primary compartment 17 and the secondary compartment 18, the primary compartment 17 is intended to house a lipstick container while the secondary compartment 18 is intended to house additional elongated applicators 3. Thus, the primary compartment 17 is preferably larger than the secondary compartment 18, as the lipstick container requires more space than the elongated applicators 3.

Further possibilities for the present invention include dividing the elongated container 1 into a first half and a second half. The first half and second half can be hingedly connected to each other, rotating about an elongated axis. This hinged construction makes the interior of the elongated container 1 easier to access, making it simpler for users to replace contents of the elongated container 1. In such an embodiment the two halves of the elongated container 1 can be secured to each other by means of a prong on one half and a prong-receptacle on the second half; a user simply engages or disengages the prong with the prong-receptacle to lock the elongated container 1 in an open or closed configuration. Effectively, this embodiment utilizes a clamshell construction for the elongated container 1. Potentially, rather than being hinged, the two halves could be completely separable, and held in place by a series of prongs and prong-receptacles or even an interference fit. Clips and other connectors or fasteners may also be used in place of prongs; indeed, any component capable of attaching two pieces can be used in conjunction with a separable construction (clamshell or otherwise) for the elongated container 1. An example of this embodiment is illustrated in FIG. 12-FIG. 17.

The present invention may be made from rigid materials including plastic, metal, crystal, or many others. Additionally the present invention may come in many colors and designs; ornamentation can help market the present invention to different consumer groups, but does not affect the configuration and functionality of the components as described in this application. Though the present invention has been described for use with lipstick, potentially other cosmetics and items can be stored in the elongated container; it is not limited to use with lipstick.

Although the invention has been explained in relation to its preferred embodiment, it is to be understood that many other possible modifications and variations can be made without departing from the spirit and scope of the invention as hereinafter claimed.

What is claimed is:

1. A portable lipstick kit comprising:

a mirror;

a lid, the lid comprising a cap portion and an applicator extending downwardly from the cap portion; and elongated container defining an internal chamber therein, the elongated container comprising:

a top surface, a closed bottom surface, and a lateral wall extending there-between, the elongated container further comprising a slot extending along a length of the lateral wall, where the mirror is removably secured within the slot;

an illumination source located on the lateral wall of the elongated container adjacent the slot;

the elongated container further comprising a height-adjustable floor located within the internal chamber adjacent the bottom surface, the height adjustable floor configured to receive a lipstick container stored within the chamber, the height-adjustable floor configured to be slidingly displaceable along the lateral wall via user-actuation of a tab extending outwardly from the height-adjustable floor through a corresponding channel in the lateral wall;

wherein the elongated container is formed by articulated halves connected via a rotatable hinge located at the bottom surface of the elongated container, the articulated halves being separable about the hinge to allow a user to insert a lipstick cosmetic within the internal chamber before connecting the articulated halves to one another in order to secure the lipstick cosmetic within the internal chamber;

wherein in a closed position, the lid is secured to an opening in the top surface of the elongated container while the applicator is fully received within the chamber and is configured to engage the lipstick cosmetic held within the chamber; and wherein in a use-position, the lid is fully detached from the elongated container and the applicator is fully withdrawn from the chamber for use.

2. The portable lipstick kit as claimed in claim 1, further comprising:

at least one illumination source perimetrically connected to the mirror.

3. The portable lipstick kit as claimed in claim 1, further comprising:

a plurality of latch receptacles adjacently connected along the lateral wall proximate to the channel and being selectively engaged with a portion of the tab of the height-adjustable floor in order to slidingly secure the height-adjustable floor to different locations along the channel.

4. The portable lipstick kit as claimed in claim 1, further comprising:

a primary compartment; a secondary compartment;

wherein the internal chamber further comprises an interior divider; the interior divider being connected across an internal face of the lateral wall; the primary compartment being positioned between the interior divider and the lateral wall, the secondary compartment being positioned between the interior divider and the lateral wall; and the primary compartment and the secondary compartment being positioned opposite each other through the interior divider.

* * * * *